US008926797B2

(12) United States Patent
Jehn-Rendu et al.

(10) Patent No.: US 8,926,797 B2
(45) Date of Patent: Jan. 6, 2015

(54) METHOD FOR INCREASING THE DRY STRENGTH OF PAPER, PAPERBOARD, AND CARDBOARD

(75) Inventors: Christian Jehn-Rendu, Eppelheim (DE); Ellen Krueger, Otterstadt (DE); Hans-Joachim Haehnle, Neustadt (DE); Martin Ruebenacker, Altrip (DE); Norbert Schall, Roemerberg (DE); Thomas Muehlenbernd, Heidelberg (DE)

(73) Assignee: BASF SE, Ludwigshafen (DE)

( * ) Notice: Subject to any disclaimer, the term of this patent is extended or adjusted under 35 U.S.C. 154(b) by 32 days.

(21) Appl. No.: 13/376,509

(22) PCT Filed: Jun. 7, 2010

(86) PCT No.: PCT/EP2010/057890

§ 371 (c)(1),
(2), (4) Date: Dec. 6, 2011

(87) PCT Pub. No.: WO2010/145956

PCT Pub. Date: Dec. 23, 2010

(65) Prior Publication Data

US 2012/0073773 A1 Mar. 29, 2012

(30) Foreign Application Priority Data

Jun. 16, 2009 (EP) ..... 09007861

(51) Int. Cl.

| | |
|---|---|
| ***D21H 17/34*** | (2006.01) |
| ***D21H 17/45*** | (2006.01) |
| ***D21H 17/46*** | (2006.01) |
| ***D21H 17/56*** | (2006.01) |
| ***D21H 17/66*** | (2006.01) |
| ***D21H 21/18*** | (2006.01) |
| *D21H 17/37* | (2006.01) |
| *D21H 17/44* | (2006.01) |
| *D21H 17/00* | (2006.01) |

(52) U.S. Cl.

CPC ..... *D21H 21/18* (2013.01); *D21H 17/37* (2013.01); *D21H 17/44* (2013.01); *D21H 17/56* (2013.01); *D21H 17/66* (2013.01); *D21H 17/74* (2013.01)

USPC ..... 162/168.3; 162/158; 162/168.1; 162/168.2; 162/181.1; 162/181.2; 162/181.3; 162/185

(58) Field of Classification Search

USPC ..... 162/164.5, 164.6, 158, 168.1, 162/168.2–168.3, 168.7, 169, 181.1–181.3, 162/183, 185

See application file for complete search history.

(56) References Cited

U.S. PATENT DOCUMENTS

| | | | | |
|---|---|---|---|---|
| 6,132,558 | A * | 10/2000 | Dyllick-Brenzinger et al. | 162/164.6 |
| 6,616,807 | B1 * | 9/2003 | Dyllick-Brenzinger et al. | 162/175 |
| 2004/0238138 | A1 * | 12/2004 | Ishizaki et al. | 162/164.6 |
| 2006/0142431 | A1 | 6/2006 | Sutman et al. | |
| 2006/0142432 | A1 * | 6/2006 | Harrington et al. | 524/13 |
| 2008/0128102 | A1 * | 6/2008 | Polverari et al. | 162/168.3 |
| 2008/0196851 | A1 * | 8/2008 | Hund et al. | 162/164.6 |
| 2009/0211719 | A1 * | 8/2009 | Sutman et al. | 162/164.6 |
| 2010/0108279 | A1 | 5/2010 | Schall et al. | |
| 2010/0179248 | A1 | 7/2010 | Esser et al. | |
| 2010/0181037 | A1 | 7/2010 | Esser et al. | |
| 2010/0181038 | A1 | 7/2010 | Esser et al. | |
| 2010/0186915 | A1 | 7/2010 | Esser et al. | |
| 2010/0280203 | A1 | 11/2010 | Feuerhake et al. | |
| 2010/0305362 | A1 | 12/2010 | Feuerhake et al. | |
| 2011/0048660 | A1 | 3/2011 | Esser et al. | |
| 2011/0079365 | A1 | 4/2011 | Haehnle et al. | |
| 2011/0132559 | A1 | 6/2011 | Haehnle et al. | |
| 2011/0155339 | A1 * | 6/2011 | Brungardt et al. | 162/164.6 |
| 2011/0290434 | A1 | 12/2011 | Jehn-Rendu et al. | |

FOREIGN PATENT DOCUMENTS

| | | |
|---|---|---|
| EP | 0 193 111 | 9/1986 |
| JP | 54 30913 | 3/1979 |
| JP | 2 112498 | 4/1990 |
| JP | 5 272092 | 10/1993 |
| JP | 8 269891 | 10/1996 |
| JP | 11 140787 | 5/1999 |
| JP | 2001 279595 | 10/2001 |
| JP | 2005 23434 | 1/2005 |
| WO | 98 06898 | 2/1998 |
| WO | WO 2006/071961 A1 | 7/2006 |
| WO | 2007 104716 | 9/2007 |
| WO | WO 2010/020551 A1 * | 2/2010 |

OTHER PUBLICATIONS

Smook, Gary A., Handbook for Pulp and Paper Technologists, 2nd ed, Angus Wilde Publications, 1992, pp. 220 and 223.*

International Search Report Issued Sep. 20, 2010 in PCT/EP10/057890 filed Jun. 7, 2010.

U.S. Appl. No. 13/375,781, filed Dec. 2, 2011, Jehn-Rendu, et al.

* cited by examiner

*Primary Examiner* — Dennis Cordray

(74) *Attorney, Agent, or Firm* — Oblon, Spivak, McClelland, Maier & Neustadt, L.L.P.

(57) ABSTRACT

Process for the production of paper, board and cardboard having high dry strength by addition of (a) at least one trivalent cation in the form of a salt, (b) at least one water-soluble cationic polymer and (c) at least one water-soluble amphoteric polymer to the paper stock, draining of the paper stock with sheet formation and subsequent drying of the paper products, the water-soluble cationic polymer (b) being selected from the group consisting of the (i) polymers comprising vinylamine units and (ii) polymers comprising ethylenimine units.

21 Claims, No Drawings

METHOD FOR INCREASING THE DRY STRENGTH OF PAPER, PAPERBOARD, AND CARDBOARD

CROSS REFERENCE TO RELATED APPLICATIONS

This application is a National Stage entry under 35 USC 371 of PCT/EP/2010/057890, filed on Jun. 7, 2010, and claims priority to European Patent Application No. 09007861.9, filed on Jun. 16, 2009.

The invention relates to a process for the production of paper, board and cardboard having high dry strength by addition of (a) at least one trivalent cation, (b) at least one water-soluble cationic polymer selected from the group consisting of the (i) polymers comprising vinylamine units and (ii) polymers comprising ethylenimine units and (c) at least one water-soluble amphoteric polymer to a paper stock, draining of the paper stock with sheet formation and drying of the paper product obtained.

The literature to date discloses numerous papers having high dry strength and the processes for their production.

JP 54-030913 discloses a process for the production of paper having high dry strength, in which first an aluminum sulfate solution is added to the paper stock. A water-soluble amphoteric polymer is then metered in. The paper stock is then drained on the paper machine with sheet formation and the paper products are dried. For example copolymers of acrylamide, acrylic acid and dimethylaminoethyl (meth) acrylate are suitable as the amphoteric polymer.

DE 35 06 832 A1 discloses a process for the production of paper having high dry strength, in which first a water-soluble cationic polymer and then a water-soluble anionic polymer are added to the paper stock. Suitable anionic polymers are, for example, homo- or copolymers of ethylenically unsaturated $C_3$-$C_5$-carboxylic acids. The copolymers comprise at least 35% by weight of an ethylenically unsaturated $C_3$-$C_5$-carboxylic acid (e.g. acrylic acid) incorporated in the form of polymerized units. In the examples, polyethylenimine, polyvinylamine, polydiallyldimethylammonium chloride and condensers of adipic acid and diethylenetriamine which have been reacted with epichlorohydrin are described as cationic polymers. The use of partly hydrolyzed homo- and copolymers of N-vinylformamide has also been considered.

JP 02-112498 relates to a process for the production of corrugated board, alaun, a polyallylamine and an anionic or amphoteric polymer being metered into a fiber suspension. The combination gives papers having a high strength.

JP 05-272092 describes a process for the production of paper having high dry strength, in which first an aluminum sulfate solution is added to the paper stock and then a water-soluble amphoteric polymer having a high molecular weight is metered in, the paper stock is then drained on the paper machine with sheet formation and the paper products are dried. For example, copolymers of acrylamide, acrylic acid, dimethylaminoethyl (meth)acrylate, (meth)acrylamide and sodium (meth)allylsulfonate are mentioned as amphoteric polymers. These amphoteric polymers are distinguished by very high molecular weights and low solution viscosities.

A variant of the process described in JP 05-272092 is disclosed in JP 08-269891. In this process for the production of paper having high dry strength, an aluminum sulfate solution is likewise first added to the paper stock and thereafter a water-soluble amphoteric polymer having a high molecular weight is metered in, the paper stock is then drained on the paper machine with sheet formation and the paper products are dried. For example, copolymers of acrylamide, acrylic acid, dimethylaminoethyl methacrylates, (meth)acrylamide, sodium (meth)allylsulfonate and a crosslinking agent, such as methylenebisacrylamides or triallylamine, are used as amphoteric polymers. These amphoteric polymers have a very high molecular weight and a solution viscosity which is further reduced compared with JP 05-272092.

EP 0 659 780 A1 describes a process for the production of polymers having a weight average molecular weight of from 1 500 000 to 10 000 000 (a) and a weight average square mean radius of from 30 to 150 nm (b), the ratio (b)/(a) being≤0.00004, and the use thereof as strength agents.

WO 98/06898 A1 describes a process for paper production, in which a cationic starch or a cationic wet strength agent and a water-soluble amphoteric polymer are added to the paper stock. This amphoteric polymer is composed of the nonionic monomers acrylamide and methacrylamide, an anionic monomer, a cationic monomer and a crosslinking agent, the amount of anionic and cationic monomer accounting for not more than 9% by weight of the total monomers used in the amphoteric polymer.

JP-A-1999-140787 relates to a process for the production of corrugated board, from 0.05 to 0.5% by weight, based on dry paper stock, of a polyvinylamine which is obtainable by hydrolysis of polyvinylformamide having a degree of hydrolysis of from 25 to 100%, in combination with an anionic polyacrylamide being added to the paper stock in order to improve the strength properties of a paper product, the paper stock then being drained with sheet formation and the paper being dried.

EP 0 919 578 A1 relates to amphoteric polymers (type B) which are prepared by means of a two-stage polymerization. First, in a first stage, a polymer (type A) is prepared by copolymerization of methallylsulfonic acid with other vinyl-monomers and then a further polymerization of vinyl monomers is effected in the presence of the polymer of type A to give the polymer of type B, the polymers of type A having a molecular weight of from 1000 to 5 000 000 and the polymers of type B having a molecular weight of from 100 000 to 10 000 000. Furthermore, this document comprises the use of the polymers of type B as strength agents for paper production and the papers produced therewith, the possibility of a combination with alaun and anionic polyacrylamides also being described. Finally, the possibility of modification with the polymers of type B via a Hofmann degradation is also mentioned.

JP 2001-279595 discloses a paper product which has improved strength properties and is obtained by metering a mixture of an amphoteric, cationic or anionic polymer and water-soluble aluminum solution into the fiber.

JP 2001-279595 relates to a process for the production of paper having high strength, a mixture of cationic, anionic or amphoteric polyacrylamide with a water-soluble aluminum compound being added to the fibers. This is followed by metering in of a further polyacrylamide. As a result, not only is the strength increased but at the same time the drainage is also improved.

WO 03/052206 A1 discloses a paper product which has improved strength properties and is obtainable by applying to the surface of a paper product a polyvinylamine or a polymeric anionic compound which can form a polyelectrolyte complex with polyvinylamine, or a polymeric compound having aldehyde functions, such as polysaccharides comprising aldehyde groups. Not only is an improvement in the dry and wet strength of the paper obtained but a sizing effect of the treatment agents is also observed.

JP 2005-023434 describes a process for the production of paper which has high strength and is obtained by metering of two polymers. The first polymer is a branched amphoteric polyacrylamide. The suitable second polymer is a copolymer of a cationic vinylmonomer as the main monomer.

DE 10 2004 056 551 A1 describes a further process for improving the dry strength of paper. In this process, separate addition of a polymer comprising vinylamine units and of a polymeric anionic compound to a paper stock, draining of the paper stock and drying of the paper products are effected, the polymeric anionic compound used being at least one copolymer which is obtainable by copolymerization of (a) at least one N-vinylcarboxamide of the formula

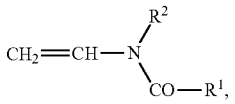

(I)

in which $R^1$, $R^2$ are H or $C_1$- to $C_6$-alkyl, (b) at least one monoethylenically unsaturated monomer comprising acid groups and/or the alkali metal, alkaline earth metal or ammonium salts thereof and optionally (c) other monoethylenically unsaturated monomers and optionally (d) compounds which have at least two ethylenically unsaturated double bonds in the molecule.

WO 2006/075115 A1 discloses the use of Hofmann degradation products of copolymers of acrylamide or methacrylamide in combination with anionic polymers having an anionic charge density of >0.1 meq/g for the production of paper and cardboard having a high dry strength.

WO 2006/120235 A1 describes a process for the production of papers having a filler content of at least 15% by weight, in which filler and fibers are treated together with cationic and anionic polymers. The treatment is effected alternately with cationic and anionic polymers and comprises at least three steps.

WO 2006/090076 A1 likewise relates to a process for the production of paper and board having high dry strength, three components being added to the paper stock:

(a) a polymer having primary amino groups and a charge density of >1.0 meq/g, (b) a second, different cationic polymer having a charge density of >0.1 meq/g, which is obtainable by free radical polymerization of cationic monomers, and (c) an anionic polymer having a charge density of >0.1 meq/g.

EP 1 849 803 A1 likewise discloses a paper additive for strengthening, which is obtained as a water-soluble polymer by polymerization of (meth)acrylamide, an α,β-unsaturated mono- or dicarboxylic acid or salts thereof, a cationic monomer and a crosslinking monomer. In a second stage, the residual monomer is polymerized with further persulfate catalyst.

Although numerous processes have already been disclosed in the literature for the production of papers having a high dry strength, there is a continuous need in the paper industry for novel, alternative processes in addition to those already known.

It is therefore the object of the present invention to provide a further process for the production of paper, board and cardboard having high dry strength, in which the dry strength properties of the paper products is further improved compared with those of known products, and in which at the same time faster draining of the paper stock is permitted.

The objects are achieved, according to the invention, by a process for the production of paper, board and cardboard having high dry strength by addition of (a) at least one trivalent cation in the form of a salt, (b) at least one water-soluble cationic polymer and (c) at least one water-soluble amphoteric polymer to the paper stock, draining of the paper stock with sheet formation and subsequent drying of the paper products, the water-soluble cationic polymer (b) being selected from the group consisting of the (i) polymers comprising vinylamine units and (ii) polymers comprising ethylenimine units.

Said components of the strength-imparting system can be added to the paper stock in any desired sequence or as a mixture of two or more components.

Suitable trivalent cations in the process according to the invention are in principle all trivalent metal or semimetal cations. Preferred metal cations are $Al^{3+}$, $Zr^{3+}$ and $Fe^{3+}$. $Al^{3+}$ is very particularly preferred.

The metal and semimetal cations are used in the form of their salts. In the case of $Al^{3+}$, this may be used, for example in the form of aluminum sulfate, polyaluminum chloride or aluminum lactate.

Of course, any desired mixtures of said trivalent metal cations may also be used but preferably only one trivalent metal cation is used in the process according to the invention. Moreover, salts differing from this metal cation may be used in any desired mixtures. In a preferred embodiment of the process according to the invention, a trivalent metal cation in one of the salt forms described is used.

The trivalent cations are usually added to the paper stock in amounts of from 3 to 100 mol per t of dry paper, preferably in the range from 10 to 30 mol per t of dry paper.

The water-soluble cationic polymer (b) is selected from the group consisting of the (i) polymers comprising vinylamine units and (ii) polymers comprising ethylenimine units.

The cationic polymers (b) are water-soluble. The solubility in water under standard conditions (20° C., 1013 mbar) and pH 7.0 is, for example, at least 5% by weight, preferably at least 10% by weight.

The charge density of the cationic polymers (without counterion) is, for example, at least 1.0 meq/g and is preferably in the range from 4 to 10 meq/g.

The water-soluble cationic polymers (b) usually have average molecular weights in the range from 10 000 to 10 000 000 dalton, preferably in the range from 20 000 to 5 000 000 dalton, particularly preferably in the range from 40 000 to 3 000 000 dalton.

Polymers (i) comprising vinylamine units are known, cf. DE 35 06 832 A1 and DE 10 2004 056 551 A1 mentioned in connection with the prior art. In the process according to the invention, reaction products which are obtainable by polymerization of at least one monomer of the formula

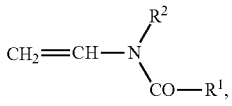

(I)

in which $R^1$, $R^2$ are H or $C_1$- to $C_6$-alkyl, and subsequent partial or complete elimination of the groups —CO—$R^1$ from the units of the monomers (I)

incorporated in the form of polymerized units into the polymer with formation of amino groups and/or by Hofmann degradation of polymers which have acrylamide and/or methacrylamide units are used as (i) polymers comprising vinylamine units.

In an embodiment of the invention, for example, the reaction products which are obtainable by polymerization of (1.) at least one monomer of the formula

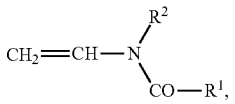

(I)

in which $R^1$, $R^2$ are H or $C_1$- to $C_6$-alkyl, (2.) optionally at least one other monoethylenically unsaturated monomer and (3.) optionally at least one crosslinking monomer having at least two double bonds in a molecule and subsequent partial or complete elimination of the groups —CO—$R^1$ from the units of the monomers (I) incorporated in the form of polymerized units into the polymer with formation of amino groups are used as (i) polymers comprising vinylamine units.

Preferably, the reaction products which are obtainable by polymerization of N-vinylformamide and subsequent elimination of formyl groups from the vinylformamide units incorporated in the form of polymerized units into the polymer with formation of amino groups are used as (i) polymers comprising vinylamine units, or the reaction products which are obtainable by copolymerization of (1.) N-vinylformamide and (2.) acrylonitrile and subsequent elimination of formyl groups from the vinylformamide units incorporated in the form of polymerized units into the copolymer with the formation of amino groups are used.

In another embodiment of the invention, the polymers comprising vinylamine units may also be amphoteric if they have an overall cationic charge. The content of cationic groups in the polymer should be at least 5 mol %, preferably at least 10 mol %, above the content of anionic groups. Such polymers are obtainable, for example, by polymerization of (1.) at least one monomer of the formula

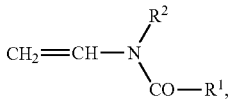

(I)

in which $R^1$, $R^2$ are H or $C_1$- to $C_6$-alkyl, (2.1) at least in each case one monomer carrying an acid function and selected from monoethylenically unsaturated sulfonic acids, monoethylenically unsaturated phosphonic acids and monoethylenically unsaturated carboxylic acids having 3 to 8 carbon atoms in a molecule and/or the alkali metal, alkaline earth metal or ammonium salts thereof, (2.2) optionally at least one other neutral and/or one cationic monomer and (3.) optionally at least one crosslinking monomer having at least two double bonds in a molecule and subsequent partial or complete elimination of the groups —CO—$R^1$ from the units of the monomers (I) incorporated in the form of polymerized units into the polymer with formation of amino groups, the content of amino groups in the copolymer being at least 5 mol % above the content of acid groups of the monomers (2.1) incorporated in the form of polymerized units.

Also of interest are amphoteric polymers which comprise vinylamine units, carry an overall cationic charge and are obtainable, for example, by copolymerization of (1.) N-vinylformamide, (2.1) acrylic acid, methacrylic acid and/or the alkali metal, alkaline earth metal or ammonium salts thereof and (2.2) optionally acrylonitrile and/or methacrylonitrile and subsequent partial or complete elimination of formyl groups from the N-vinylformamide incorporated in the form of polymerized units into the polymer with the formation of amino groups, the content of amino groups in the copolymer being at least 5 mol % above the content of acid groups of the monomers (2.1) incorporated in the form of polymerized units.

Examples of monomers of the formula (I) are N-vinylformamide, N-vinyl-N-methylformamide, N-vinylacetamide, N-Vinyl-N-methylacetamide, N-vinyl-N-ethylacetamide, N-vinylpropionamide and N-vinyl-N-methylpropionamide and N-vinylbutyramide. The monomers of group (a) may be used alone or as a mixture in the copolymerization with the monomers of the other groups. A preferably used monomer of this group is N-vinylformamide.

These polymers can, if necessary, be modified by copolymerizing the N-vinylcarboxamides (1.) together with (2.) at least one other monoethylenically unsaturated monomer and then hydrolyzing the copolymers with formation of amino groups. If anionic monomers are used in the copolymerization, the hydrolysis of the vinyl carboxamide units incorporated in the form of polymerized units is continued until the molar excess of amine units relative to the anionic units in the polymer is at least 5 mol %.

Examples of monomers of group (2.) are esters of α,β-ethylenically unsaturated mono-and dicarboxylic acids with $C_1$-$C_{30}$-alkanols, $C_2$-$C_{30}$-alkanediols and $C_2$-$C_{30}$-aminoalcohols, amides of α,β-ethylenically unsaturated monocarboxylic acids and the N-alkyl and N,N-dialkyl derivatives thereof, nitriles of α,β-ethylenically unsaturated mono- and dicarboxylic acids, esters of vinyl alcohol and allyl alcohol with $C_1$-$C_{30}$-monocarboxylic acids, N-vinyllactams, nitrogen-containing heterocycles having α,β-ethylenically unsaturated double bonds, vinyl aromatics, vinyl halides, vinylidene halides, $C_2$-$C_8$-monoolefins and mixtures thereof.

Suitable representatives are, for example, methyl (meth) acrylate (where (meth)acrylate in the context of the present invention means both acrylate and methacrylate), methyl ethacrylate, ethyl (meth)acrylate, ethyl ethacrylate, n-butyl (meth)acrylate, isobutyl (meth)acrylate, tert-butyl (meth) acrylate, tert-butyl ethacrylate, n-octyl (meth)acrylate, 1,1,3,3-tetramethylbutyl (meth)acrylate, ethylhexyl (meth)acrylate and mixtures thereof.

Suitable additional monomers of group (2.) are furthermore the esters of α,β-ethylenically unsaturated mono- and dicarboxylic acids with amino alcohols, preferably $C_2$-$C_{12}$-aminoalcohols. These may be $C_1$-$C_8$-monoalkylated or -dialkylated on the amine nitrogen. For example, acrylic acid, methacrylic acid, fumaric acid, maleic acid, itaconic acid, crotonic acid, maleic anhydride, monobutyl maleate and mixtures thereof are suitable as the acid component of these esters. Acrylic acid, methacrylic acid and mixtures thereof are preferably used. These include, for example, N-methylaminomethyl (meth)acrylate, N-methylaminoethyl (meth)acrylate, N,N-dimethylaminomethyl (meth)acrylate, N,N-dimethylaminoethyl (meth)acrylate, N,N-diethylaminoethyl (meth)acrylate, N,N-dimethylaminopropyl (meth)acrylate, N,N-diethylaminopropyl (meth)acrylate and N,N-dimethylaminocyclohexyl (meth)acrylate.

2-Hydroxyethyl (meth)acrylate, 2-hydroxyethyl ethacrylate, 2-hydroxypropyl (meth)acrylate, 3-hydroxypropyl (meth)acrylate, 3-hydroxybutyl (meth)acrylate, 4-hydroxybutyl (meth)acrylate, 6-hydroxyhexyl (meth)acrylate and mixtures thereof are furthermore suitable as monomers of group (2.).

Suitable additional monomers of group (2.) are furthermore acrylamide, methacrylamide, N-methyl(meth)acrylamide, N-ethyl(meth)acrylamide, n-propyl(meth)acrylamide, N-(n-butyl)(meth)acrylamide, tert-butyl(meth)acrylamide, n-octyl(meth)acrylamide, 1,1,3,3-tetramethylbutyl(meth)acrylamide, ethylhexyl(meth)acrylamide and mixtures thereof.

In addition, N-[2-(dimethylamino)ethyl]acrylamide, N-[2-(dimethylamino)ethyl]methacrylamide, N[3-(dimethylamino)propyl]acrylamide, N-[3-(dimethylamino)propyl]methacrylamide, N[4-(dimethylamino)butyl]acrylamide, N-[4-(dimethylamino)butyl]methacrylamide, N[2-(diethylamino)ethyl]acrylamide, N-[2-(diethylamino)ethyl]methacrylamide and mixtures thereof are suitable as monomers of group (2.).

Further examples of monomers of group (2.) are nitriles of α,β-ethylenically unsaturated mono- and dicarboxylic acids, such as, for example, acrylonitrile and methacrylonitrile. The presence of units of these monomers in the copolymer leads, during or after the hydrolysis, to products which have amidine units, cf. for example EP 0 528 409 A1 or DE 43 28 975 A1. In the hydrolysis of N-vinylcarboxamide polymers, a secondary reaction does in fact result in the formation of amidine units by reaction of vinylamine units with a neighboring vinylformamide unit or—if a nitrile group is present as the neighboring group in the polymer—with said nitrile group. Below, the indication of vinylamine units in the amphoteric copolymers or in unmodified homo- or copolymers always means the sum of vinylamine and amidine units.

Suitable monomers of group (2.) are furthermore N-vinyllactams and derivatives thereof which may have, for example, one or more $C_1$-$C_6$-alkyl substituents (as defined above). These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

Further suitable monomers of group (2.) are N-vinylimidazoles and alkylvinylimidazoles, in particular methylvinylimidazoles, such as, for example, 1-vinyl-2-methylimidazole, 3-vinylimidazole N-oxide, 2- and 4-vinylpyridin N-oxides and betaine derivatives and quaternization products of these monomers and ethylene, propylene, isobutylene, butadiene, styrene, α-methylstyrene, vinyl acetate, vinyl propionate, vinyl chloride, vinylidene chloride, vinyl fluoride, vinylidene fluoride and mixtures thereof.

The abovementioned monomers can be used individually or in the form of any desired mixtures. Typically, they are used in amounts of from 1 to 90 mol %, preferably from 10 to 80 mol % and particularly preferably from 10 to 60 mol %.

For the preparation of amphoteric copolymers, anionic monomers which are designated above as monomers (2.1) are also suitable as other monoethylenically unsaturated monomers of group (2.). They can, if necessary, be copolymerized with the neutral and/or cationic monomers (2.2) described above. The amount of anionic monomers (2.1) is, however, not more than 45 mol % in order for the amphoteric copolymer formed to have an overall cationic charge.

Examples of anionic monomers of group (2.1) are ethylenically unsaturated $C_3$- to $C_8$-carboxylic acids, such as, for example, acrylic acid, methacrylic acid, dimethacrylic acid, ethacrylic acid, maleic acid, fumaric acid, itaconic acid, mesaconic acid, citraconic acid, methylenemalonic acid, allylacetic acid, vinylacetic acid and crotonic acid. Other suitable monomers of this group are monomers comprising sulfo groups, such as vinylsulfonic acid, acrylamido-2-methylpropanesulfonic acid and styrenesulfonic acid, and monomers comprising phosphono groups, such as vinylphosphonic acid. The monomers of this group can be used alone or as a mixture with one another, in partly or in completely neutralized form in the copolymerization. For example, alkali metal or alkaline earth metal bases, ammonia, amines and/or alkanolamines are used for the neutralization. Examples of these are sodium hydroxide solution, potassium hydroxide solution, sodium carbonate, potassium carbonate, sodium bicarbonate, magnesium oxide, calcium hydroxide, calcium oxide, triethanolamine, ethanolamine, morpholine, diethylenetriamine and tetraethylenepentamine.

A further modification of the copolymers is possible by using, in the copolymerization, monomers of group (3.) which comprise at least two double bonds in the molecule, e.g. triallylamine, methylenebisacrylamide, glycol diacrylate, glycol dimethacrylate, glyceryl triacrylate, pentaerythrityl triallyl ether, polyalkylene glycols which are at least diesterified with acrylic acid and/or methacrylic acid or polyols, such as pentaerythritol, sorbitol or glucose. These are so-called crosslinking agents. If at least one monomer of the above group is used in the polymerization, the amounts used are up to 2 mol %, e.g. from 0.001 to 1 mol %.

Furthermore, for modification of the polymers, it may be expedient to combine the use of above crosslinking agents with the addition of chain-transfer agents. Typically, from 0.001 to 5 mol % are used. All chain-transfer agents known from literature, for example sulfur compounds, such as mercaptoethanol, 2-ethylhexyl thioglycolate, thioglycolic acid and dodecyl mercaptan, and sodium hypophosphite, formic acid or tribromochloromethane and terpinolene may be used.

The polymers (i) comprising vinylamine units also include hydrolyzed graft polymers of, for example, N-vinylformamide on polyalkylene glycols, polyvinyl acetate, polyvinyl alcohol, polyvinylformamides, polysaccharides, such as starch, oligosaccharides or monosaccharides. The graft polymers are obtainable by, for example, subjecting N-vinylformamide to free radical polymerization in an aqueous medium in the presence of at least one of said grafting bases, optionally together with copolymerizable other monomers, and then hydrolyzing the grafted-on vinylformamide units in a known manner to give vinylamine units.

The hydrolysis of the copolymers described above can be carried out in the presence of acids or bases or enzymatically. In the hydrolysis with acids, the vinylamine groups forming from the vinylcarboxamide units are present in salt form. The hydrolysis of vinylcarboxamide copolymers is described in detail in EP 0 438 744 A1, page 8, line 20 to page 10, line 3. The statements made there apply in a corresponding manner to the preparation of the purely cationic and/or amphoteric polymers to be used according to the invention, comprising vinylamine units and having an overall cationic charge.

The preparation of the above-described homo- and copolymers (i) comprising vinylamine units can be effected by a solution, precipitation, suspension or emulsion polymerization. Solution polymerization in aqueous media is preferred.

Suitable aqueous media are water and mixtures of water and at least one water-miscible solvent, e.g. an alcohol, such as methanol, ethanol, n-propanol or isopropanol.

As described above, the reaction products which are obtainable by a Hofmann degradation of homo- or copolymers of acrylamide or of methacrylamide in an aqueous medium in the presence of sodium hydroxide solution and sodium hypochlorite and subsequent decarboxylation of the carbamate groups of the reaction products in the presence of an acid are also suitable as (i) polymers comprising vinylamine units. Such polymers are disclosed, for example in EP 0 377 313 and WO 2006/075115 A1. The preparation of polymers comprising vinylamine groups is discussed in detail, for example in WO 2006/075115 A1, page 4, line 25 to page 10, line 22, and in the examples on pages 13 and 14. The statements made there apply to the characterization of the polymers prepared by Hofmann degradation and comprising vinylamine units.

Polymers which comprise acrylamide and/or methacrylamide units are used as starting material. These are homo- or copolymers of acrylamide and methacrylamide. Suitable comonomers are, for example, dialkylaminoalkyl(meth)acrylamide, diallylamine, methyldiallylamine and the salts of the amines and the quaternized amines. Also suitable as comonomers are dimethyldiallylammonium salts, acrylamidopropyltrimethyl-ammonium chloride and/or methacrylamidopropyltrimethylammonium chloride, N-vinylformamide, N-vinylacetamide, N-vinylpyrrolidone, vinyl acetate and acrylates and methacrylates. Optionally, anionic monomers, such as acrylic acid, methacrylic acid, maleic anhydride, maleic acid, itaconic acid, acrylamidomethylpropanesulfonic acid, methallylsulfonic acid and vinylsulfonic acid and the alkali metal, alkaline earth metal and ammonium salts of said acidic monomers are also suitable as comonomers, not more than 5 mol % of these monomers being used in the polymerization. The amount of water-insoluble monomers is chosen in the polymerization so that the resulting polymers are soluble in water.

Optionally, crosslinking agents, for example ethylenically unsaturated monomers which comprise at least two double bonds in the molecule, such as triallylamine, methylenebisacrylamide, ethylene glycol diacrylate, ethylene glycol dimethacrylate, polyethylene glycol dimethacrylate and trimethylol trimethacrylate may also be used as comonomers. If a crosslinking agent is used, the amounts used are, for example, from 5 to 5000 ppm. The polymerization of the monomers can be effected by all known processes, for example by a free radical solution, precipitation or suspension polymerization. Optionally, the procedure can be effected in the presence of customary chain-transfer agents.

In the Hofmann degradation, for example, from 20 to 40% strength by weight aqueous solutions of at least one polymer comprising acrylamide and/or methacrylamide units are used as starting material. The ratio of alkali metal hypochlorite to (meth)acrylamide units in the polymer is decisive for the resulting content of amine groups in the polymer. The molar ratio of alkali metal hydroxide to alkali metal hypochlorite is, for example, from 2 to 6, preferably from 2 to 5. The amount of alkali metal hydroxide required for the degradation of the polymer is calculated for a certain amine group content in the degraded polymer.

The Hofmann degradation of the polymer is effected, for example, in the temperature range from 0 to 45° C., preferably from 10 to 20° C., in the presence of quaternary ammonium salts as a stabilizer, in order to prevent a secondary reaction of the resulting amino groups with the amide groups of the starting polymer. After the end of the reaction with alkali metal hydroxide/alkali metal hypochlorite, the aqueous reaction solution is passed into a reactor in which an acid is initially taken for the decarboxylation of the reaction product. The pH of the reaction product comprising vinylamine units is adjusted to a value of from 2 to 7. The concentration of the degradation product comprising vinylamine units is, for example, more than 3.5% by weight; in general, it is above 4.5% by weight. The aqueous polymer solutions can be concentrated, for example, with the aid of ultrafiltration.

The polymers (ii) comprising ethylenimine units include all polymers which are obtainable by polymerization of ethylenimine in the presence of acids, Lewis acids or haloalkanes such as homopolymers of ethylenimine or graft polymers of ethylenimine, cf. U.S. Pat. No. 2,182,306 or U.S. Pat. No. 3,203,910. These polymers can, if necessary, be subsequently subjected to crosslinking. Suitable crosslinking agents are, for example, all polyfunctional compounds which comprise groups reactive toward primary amino groups, for example polyfunctional epoxides, such as bisglycidyl ethers of oligo- or polyethylene oxides or other polyfunctional alcohols, such as glycerol or sugars, polyfunctional carboxylates, polyfunctional isocyanates, polyfunctional acrylates or methacrylates, polyfunctional acrylamides or methacrylamides, epichlorohydrin, polyfunctional acid halides, polyfunctional nitriles, α,ω-chlorohydrin ethers of oligo- or polyethylene oxides or of other polyfunctional alcohols, such as glycerol or sugars, divinyl sulfone, maleic anhydride or ω-halocarboxylic acid chlorides, polyfunctional haloalkanes, in particular α,ω-dichloroalkanes. Further crosslinking agents are described in WO 97/25367 A1, pages 8 to 16.

Polymers comprising ethylenimine units are disclosed, for example, in EP 0 411 400 A1, DE 24 34 816 A1 and U.S. Pat. No. 4,066,494.

For example, at least one water-soluble cationic polymer from the group consisting of the

- homopolymers of ethylenimine,
- polyethylenimines reacted with at least bifunctional crosslinking agents,
- polyamidoamines which have been grafted with ethylenimine and reacted with at least bifunctional crosslinking agents,
- reaction products of polyethylenimines with monobasic carboxylic acids to give amidated polyethylenimines,
- Michael adducts of polyethylenimines with ethylenically unsaturated acids, salts, esters, amides or nitriles of monoethylenically unsaturated carboxylic acids,
- phosphonomethylated polyethylenimines,
- carboxylated polyethylenimines and
- alkoxylated polyethylenimines is used as (ii) polymers comprising ethylenimine units in the process according to the invention.

Polymers which are obtained by first subjecting at least one polycarboxylic acid to condensation with at least one polyamine to give polyamidoamines then effecting grafting with ethylenimine and then crosslinking the reaction products with one of the abovementioned compounds are among the preferred compounds comprising ethylenimine units. A process for the preparation of such compounds is described, for example, in DE 24 34 816 A1, α,ω-chlorohydrin ethers of oligo- or polyethylene oxides being used as crosslinking agents.

Particularly preferred products are those of the two abovementioned types which were subjected to ultrafiltration and thus optimized in their molecular weight distribution. Such products which have been subjected to ultrafiltration are described in detail in WO 00/67884 A1 and WO 97/25367 A1.

At this point, these publications and the disclosure present therein are hereby incorporated by reference.

Products of the reaction of polyethylenimines with monobasic carboxylic acids to give amidated polyethylenimines are disclosed in WO 94/12560 A1. Michael adducts of polyethylenimines with ethylenically unsaturated acids, salts, esters, amides or nitriles of monoethylenically unsaturated carboxylic acids form the subject matter of WO 94/14873 A1. Phosphonomethylated polyethylenimines are described in detail in WO 97/25367 A1. Carboxylated polyethylenimines are obtainable, for example, with the aid of a Strecker synthesis by reaction of polyethylenimines with formaldehyde and ammonia/hydrogen cyanide and hydrolysis of the reaction products. Alkoxylated polyethylenimines can be prepared by reacting polyethylenimines with alkylene oxides, such as ethylene oxide and/or propylene oxide.

In the process according to the invention, the (i) polymers comprising vinylamine units or (ii) polymers comprising ethylenimine units can be used, in each case alone, as water-soluble cationic polymer (b). Of course, it is also possible to use any desired mixture of (i) polymer comprising vinylamine units and (ii) polymer comprising ethylenimine units. In such a mixture, the weight ratio of (i) polymers comprising vinylamine units to (ii) polymers comprising ethylenimine units is, for example, from 10:1 to 1:10, preferably in the range from 5:1 to 1:5 and particularly preferably in the range from 2:1 to 1:2.

The at least one water-soluble cationic polymer (b) is used in the process according to the invention for the production of paper, for example, in an amount of from 0.01 to 2.0% by weight, preferably from 0.03 to 1.0% by weight, particularly preferably from 0.1 to 0.5% by weight, based in each case on dry paper stock.

The amphoteric polymers (c) are water-soluble. The solubility in water under standard conditions (20° C., 1013 mbar) and pH 7.0 is, for example, at least 5% by weight, preferably at least 10% by weight.

The water-soluble amphoteric polymers (c) which can be used in the process according to the invention are composed of at least three structural units:

(A) structural units which carry a permanently cationic group or a group protonatable in an aqueous medium, (B) structural units which carry a group deprotonatable in an aqueous medium, and (C) nonionic structural units.

In addition, the water-soluble amphoteric polymers (c) may also comprise crosslinking agents and/or chain-transfer agents. Such crosslinking agents and chain-transfer agents are likewise those which are already used in the case of the water-soluble cationic polymers (b).

Examples of monomers whose polymers comprise structural units (A) are esters of α,β-ethylenically unsaturated mono- and dicarboxylic acids with $C_2$-$C_{30}$-aminoalcohols, amides of α,β-ethylenically unsaturated monocarboxylic acids and the N-alkyl and N,N-dialkyl derivatives thereof, nitrogen-containing heterocycles having α,β-ethylenically unsaturated double bonds and mixtures thereof.

Suitable monomers of this group are the esters of α,β-ethylenically unsaturated mono-and dicarboxylic acids with aminoalcohols, preferably $C_2$-$C_{12}$-aminoalcohols. These may be $C_1$-$C_8$-monoalkylated or -dialkylated on the amine nitrogen. For example, acrylic acid, methacrylic acid, fumaric acid, maleic acid, itaconic acid, crotonic acid, maleic anhydride, monobutyl maleate and mixtures thereof are suitable as the acid component of these esters. Acrylic acid, methacrylic acid and mixtures thereof are preferably used. These include, for example, N-methylaminomethyl (meth)acrylate, N-methylaminoethyl (meth)acrylate, N,N-dimethylaminomethyl (meth)acrylate, N,N-dimethylaminoethyl (meth)acrylate, N,N-diethylaminoethyl (meth)acrylate, N,N-dimethylaminopropyl (meth)acrylate, N,N-diethylaminopropyl (meth)acrylate and N,N-dimethylaminocyclohexyl (meth)acrylate.

In addition, N-[2-(dimethylamino)ethyl]acrylamide, N-[2-(dimethylamino)ethyl]methacrylamide, N-[3-(dimethylamino)propyl]acrylamide, N-[3-(dimethylamino)propyl]methacrylamide, N-[4-(dimethylamino)butyl]acrylamide, N-[4-(dimethylamino)butyl]methacrylamide, N-[2-(diethylamino)ethyl]acrylamide, N-[2-(diethylamino)ethyl]methacrylamide and mixtures thereof are suitable as further monomers of this group.

Furthermore, N-vinylimidazoles and alkylvinylimidazoles, in particular methylvinylimidazoles, such as, for example, 1-vinyl-2-methylimidazole, 3-vinylimidazole-N-oxide, 2- and 4-vinylpyridine-N-oxides and betaine derivatives and quaternization products of these monomers and mixtures thereof are suitable as monomers.

Among the abovementioned monomers, the respective quaternary compounds are likewise suitable. The quaternary compounds of the monomers are obtained by reacting the monomers with known quaternization agents, for example with methyl chloride, benzyl chloride, ethyl chloride, butyl bromide, dimethyl sulfate and diethyl sulfate or alkyl epoxides.

Examples of monomers whose polymers comprise structural units (B) are those which carry an acid function. These are selected from monoethylenically unsaturated sulfonic acids, monoethylenically unsaturated phosphonic acids and monoethylenically unsaturated carboxylic acids having 3 to 8 carbon atoms in the molecule and/or the alkali metal, alkaline earth metal or ammonium salts thereof.

Examples of such monomers of this group are ethylenically unsaturated $C_3$- to $C_8$-carboxylic acids, such as, for example, acrylic acid, methacrylic acid, dimethacrylic acid, ethacrylic acid, maleic acid, fumaric acid, itaconic acid, mesaconic acid, citraconic acid, methylenemalonic acid, allylacetic acid, vinylacetic acid and crotonic acid. Other suitable monomers of this group are monomers comprising sulfo groups such as vinylsulfonic acid, acrylamido-2-methylpropanesulfonic acid and styrenesulfonic acid, and monomers comprising phosphono groups, such as vinylphosphonic acid.

Preferred monomers comprising sulfo groups are in particular those of the formula (II) and salts thereof (II)

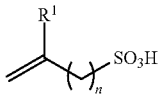

in which $R^1$ is H or a $C_1$-$C_4$-alkyl group and n is an integer in the range from 1 to 8.

The monomers of this group can be used alone or as a mixture with one another, in partly or in completely neutralized form in the copolymerization. For example, alkali metal or alkaline earth metal bases, ammonia, amines and/or alkanolamines are used for the neutralization. Examples of these are sodium hydroxide solution, potassium hydroxide solution, sodium carbonate, potassium carbonate, sodium bicarbonate, magnesium oxide, calcium hydroxide, calcium oxide, triethanolamine, ethanolamine, morpholine, diethylenetriamine or tetraethylenepentamine.

Monomers whose polymers comprise structural units (C) are monomers of the formula (I), esters of α,β-ethylenically unsaturated mono- and dicarboxylic acids with $C_1$-$C_{30}$-alkanols and $C_2$-$C_{30}$-alkanediols, (meth)acrylamides, nitriles of α,β-ethylenically unsaturated mono- and dicarboxylic acids, esters of vinyl alcohol and allyl alcohol with $C_1$-$C_{30}$-monocarboxylic acids, N-vinyllactams and mixtures thereof.

Monomers of the formula (I) are, for example, N-vinylformamide, N-vinyl-N-methylformamide, N-vinylacetamide, N-vinyl-N-methylacetamide, N-vinyl-N-ethylacetamide, N-vinylpropionamide and N-vinyl-N-methylpropionamide and N-vinylbutyramide. These monomers can be used alone or as a mixture in the copolymerization with the monomers of the other groups. A preferably used monomer of this group is N-vinylformamide.

Suitable representatives of this group of monomers are, for example, methyl (meth)acrylate, methyl ethacrylate, ethyl (meth)acrylate, ethyl ethacrylate, n-butyl (meth)acrylate, isobutyl (meth)acrylate, tert-butyl (meth)acrylate, tert-butyl ethacrylate, n-octyl (meth)acrylate, 1,1,3,3-tetramethylbutyl (meth)acrylate, ethylhexyl (meth)acrylate and mixtures thereof.

Furthermore, 2-hydroxyethyl (meth)acrylate, 2-hydroxyethyl ethacrylate, 2-hydroxypropyl (meth)acrylate, 3-hydroxypropyl (meth)acrylate, 3-hydroxybutyl (meth)acrylate, 4-hydroxybutyl (meth)acrylate, 6-hydroxyhexyl (meth)acrylate and mixtures thereof are suitable as monomers of this group.

Suitable additional monomers are furthermore acrylamide, methacrylamide, N-methyl(meth)acrylamide, N-ethyl(meth)acrylamide, n-propyl(meth)acrylamide, N-(n-butyl)(meth)acrylamide, tert-butyl(meth)acrylamide, n-octyl(meth)acrylamide, 1,1,3,3-tetramethylbutyl(meth)acrylamide, ethylhexyl(meth)acrylamide and mixtures thereof.

In addition, nitriles of α,β-ethylenically unsaturated mono- and dicarboxylic acids, such as, for example, acrylonitrile and methacrylonitrile, are suitable.

Suitable monomers of this group are furthermore N-vinyllactams and derivatives thereof which may have, for example, one or more $C_1$-$C_6$-alkyl substituents (as defined above). These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

Usually, the proportion of monomers whose polymers comprise the structural units (C) in the water-soluble amphoteric polymer is at least 50% by weight, based on the total weight of the monomers which are used for the preparation of the water-soluble polymer (c). Preferably, the proportion of monomers whose polymers comprise the structural units (C) is at least 60% by weight, particularly preferably at least 75% by weight and especially preferably at least 85% by weight, but not more than 98% by weight, based in each case on the total weight of the monomers which are used for the preparation of the water-soluble polymer (c).

The molar ratio of the monomers whose polymers comprise the structural units (A) to those whose polymers comprise the structural units (B) is usually in the range from 5:1 to 1:5, preferably from 2:1 to 1:2 and particularly preferably 1:1.

Such water-soluble amphoteric polymers (c) are known in the literature, as is their preparation. For example, the amphoteric polymers can be prepared by free radical polymerization of the abovementioned monomers in solution, as gel polymerization, precipitation polymerization, water-in-water polymerization, water-in-oil polymerization or by spray polymerization.

The preparation is described, inter alia, in JP 54-030913, the disclosure of which is hereby incorporated by reference at this point.

In the process according to the invention, preferably used water-soluble amphoteric polymers (c) are those as disclosed in EP 0 659 780 A1, EP 0 919 578 A1, EP 1 849 803 A1, JP 08-269891, JP 2005-023434 and JP 2001-1279595.

The at least one water-soluble amphoteric polymer (c) is used in the process according to the invention, for the production of paper, for example, in an amount of from 0.01 to 2.0% by weight, preferably from 0.03 to 1.0% by weight, particularly preferably from 0.1 to 0.5% by weight, based in each case on dry paper stock.

The present invention also relates to the papers, board and cardboard produced by the process described above.

For paper production, suitable fibers for the production of the pulps are all qualities customary for this purpose, for example mechanical pulp, bleached and unbleached chemical pulp and paper stocks from all annual plants. Mechanical pulp includes, for example, groundwood, thermomechanical pulp (TMP), chemothermomechanical pulp (CTMP), pressure groundwood, semichemical pulp, high-yield chemical pulp and refiner mechanical pulp (RMP). For example, sulfate, sulfite and soda pulps are suitable as chemical pulp. For example, unbleached chemical pulp, which is also referred to as unbleached craft pulp, is used. Suitable annual plants for the production of paper stocks are, for example, rice, wheat, sugarcane and kenaf.

The process according to the invention is suitable in particular for the production of papers treated to impart dry strength and obtained from wastepaper (comprising deinked wastepaper), which is used either alone or as a mixture with other fibers. It is also possible to start from fiber mixtures comprising a primary stock and recycled coated broke, for example bleached pine sulfate mixed with recycled coated broke. The process according to the invention is of industrial interest for the production of paper, board and cardboard from wastepaper and, in special cases, also from deinked wastepaper, because it substantially increases the strength properties of the recycled fibers. It is particularly important for improving strength properties of graphic arts papers and of packaging papers.

The pH of the stock suspension is, for example, in the range from 4.5 to 8, in general from 6 to 7.5. For example, an acid, such as sulfuric acid, or aluminum sulfate can be used for adjusting the pH.

In the process according to the invention, the sequence of addition of the components (a), (b) and (c) is arbitrary, it being possible for the components to be added individually or in any mixture to the fiber suspension. For example, in the process according to the invention, first the cationic components, namely the (a) trivalent cations in the form of a salt and (b) water-soluble cationic polymers, are metered into the paper stock. The addition of the cationic components (a) and (b) can be effected separately or as a mixture to the high-consistency stock (fiber concentration>15 g/l, e.g. in the range from 25 to 40 g/l up to 60 g/l) or preferably to the low-consistency stock (fiber concentration<15 g/l, e.g. in the range from 5 to 12 g/l). The point of addition is preferably situated before the wires but may also be situated between a shearing stage and a screen or thereafter. The metering of the cationic components (a) and (b) to the paper stock can be effected, as described above, in succession, simultaneously or as a mixture (a) and (b). If, in the case of the water-soluble component (b), a mixture of (i)

polymers comprising vinylamine units and (ii) polymers comprising ethylenimine units is used, it is also possible to meter these in succession, simultaneously or as a mixture of (i) and (ii).

The water-soluble amphoteric polymer (c) is generally added only after the addition of the cationic components (a) and (b) to the paper stock, but can also be added simultaneously and also as a mixture with (a) and (b) to the paper stock. Furthermore, it is also possible first to add the water-soluble amphoteric polymer (c) and then the cationic components (a) and (b) or initially one of the cationic components (a) or (b) to the paper stock, then to add the water-soluble amphoteric polymer (c) and then to add the other cationic component (a) or (b).

In a preferred embodiment of the process according to the invention, preferably the (a) trivalent cation in the form of a salt is added first, then the (b) water-soluble cationic polymer and then the (c) water-soluble amphoteric polymer.

In another, likewise preferred variant of the process according to the invention, the (a) trivalent cation in the form of a salt is added first, then the (c) water-soluble amphoteric polymer and finally the (b) water-soluble cationic polymer.

In a third, likewise preferred embodiment, a mixture of the (a) trivalent cation in the form of a salt and of the (c) water-soluble amphoteric polymer is first added to the paper stock. Thereafter, the (b) water-soluble cationic polymer is metered in.

In the process according to the invention, the process chemicals usually used for the paper production can be used in the customary amounts, for example retention aids, drainage aids, other dry strength agents, such as, for example, starch, pigments, fillers, optical brighteners, antifoams, biocides and paper dyes.

The process according to the invention gives papers which have been treated to impart dry strength and whose dry strength is greater compared with papers which are produced by known processes. Moreover, in the process according to the invention, the drainage rate is improved in comparison with known processes.

The invention is illustrated in more detail with reference to the following, nonlimiting examples.

The stated percentages in the examples are percent by weight, unless stated otherwise. The K value of the polymers was determined according to Fikentscher, Cellulose-Chemie, volume 13, 58-64 and 71-74 (1932) at a temperature of 25° C. in 5% strength by weight aqueous sodium chloride solutions at a pH of 7 and a polymer concentration of 0.5%. Here, K=k·1000.

For the individual tests, sheets were produced in laboratory experiments in a Rapid-Köthen laboratory sheet former. The sheets were stored for 24 hours at 23° C. and a relative humidity of 50%. Thereafter, the following strength tests were carried out:

- bursting strength according to DIN ISO 2758 (up to 600 kPa), DIN ISO 2759 (from 600 kPa)
- SCT according to DIN 54518 (determination of the strip compressive strength)
- CMT according to DIN EN 23035 (determination of the flat crush resistance)
- wet breaking length according to TAPPI T 456
- ash content according to TAPPI T 413
- drainage time according to ISP standard 5267 (determined using a Schopper-Riegler tester, in which in each case 1 l of the fiber suspension to be tested, having a consistency of 10 g/l, was drained and the time in seconds which was required for 600 ml of filtrate to pass through was determined)

EXAMPLES

The following components or polymers were used in the examples:

Cation 1

Alaun (technical-grade aluminum sulfate powder [$Al_2(SO_4)_3.14H_2O$])

Cation 2

Polyaluminum chloride comprising 18% of $Al_2O_3$ (Sedipur® PAC 18 from BASF SE)

Polymer K1

Cationic polyvinylformamide, partly hydrolyzed to a degree of 30 Mol %, molecular weight about 350 000 dalton, solids content 16.4% by weight (Luredur® PR 8095 from BASF SE)

Polymer K2

Cationic polyethylenimine, molecular weight about 1 000 000 dalton (Polymin® SK from BASF SE)

Polymer K3

Cationic polyvinylamine, Hofmann degradation product, molecular weight about 25 000 dalton, solids content 8% by weight (RSL HF 70D from SNF SAS)

Polymer A1

Amphoteric polyacrylamide, solids content 19.2% by weight (Harmide® RB 217 from Harima)

Polymer A2

Amphoteric polyacrylamide, solids content 20% by weight (Polystron® PS-GE 200 R from Arakawa)

Polymer A3

Amphoteric polyacrylamide, solids content 20% by weight (Polystron® PS-GE 300 S Arakawa)

In addition, the following comparative polymers were optionally used in the comparative examples:

Polymer C1

Cationic polyacrylamide, molecular weight about 1 000 000 dalton, (Polymin® KE 440 from BASF SE)

Polymer C2

Anionic polyacrylamide, molecular weight about 600 000 dalton, solids content 16% by weight (Luredur® PR 8284 from BASF SE)

Polymer C3

Polyallylamine, molecular weight about 15 000 dalton, solids content 93% by weight (PAA-HCl-3S from Nittobo)

Production of the paper stock for the examples and comparative examples

A paper comprising 100% of wastepaper (mixture of the types: 1.02, 1.04, 4.01) was beaten free of fiber bundles with tap water at a consistency of 4% in a laboratory pulper and beaten to a freeness of 40° SR in a laboratory refiner. This stock was then diluted to a consistency of 0.7% with tap water.

Drainage Test

In the examples and comparative examples, in each case 1 liter of the paper stock described above was used and in each case the trivalent cations and water-soluble polymers stated in each case in the table were added in succession and drainage was then effected with the aid of a Schopper-Riegler drainage tester, the time in seconds for an amount (filtrate) of 600 ml to pass through being determined. The concentration of the water-soluble cationic and amphoteric polymers, which were tested in each case as dry strength agents for paper, was in each case 1%, and that of the trivalent cation in aqueous solution was in each case 10%. The results of the measurements are summarized in Tables 1, 2a and 2b, the data for the bursting strength, SCT and CMT being represented in each case as an increase in % relative to the zero value determination (comparison 0). The values for the wet breaking length are stated in m, in particular as a difference measurement relative to the zero value determination (comparison 0).

Sheet Formation

In the examples and comparative examples, the trivalent cations and polymers stated in the tables were added successively to the paper stock described above with stirring. The polymer concentration of the aqueous solutions of the cationic and of the anionic polymers was in each case 1% and that of the trivalent cation in aqueous solution was in each case 10%. In addition, 0.27% of a commercially available antifoam (Afranil® SLO from BASF SE) was used in all examples and comparative examples. In the table, the respective amounts of the trivalent cations and polymers used, in percent by weight, based on the solids content of the paper stock, are stated. After the final addition of a water-soluble polymer to the paper stock, an amount of stock (about 500 ml) was taken off which was sufficient for producing a sheet having a basis weight of 120 g/m$^2$ on a Rapid-Köthen sheet former. The sheets were pressed out as customary in the Rapid-Köthen method and were dried for 8 minutes at 110° C. in a drying cylinder. The results are stated in Tables 1, 2a and 2b, the data for the bursting strength, SCT and CMT being presented in each case as an increase in % relative to the zero value determination (comparison 0). The values of the wet breaking length are stated in m, in particular likewise as an increase relative to the zero value determination (comparison 0).

The experiments according to the invention, examples 1 to 10, show in particular the surprisingly good effect of the system consisting of three components on the dry strength and at the same time on the drainage.

TABLE 1

| Example | Trivalent cation | Dose [%] | Cationic Polymer | Dose [%] | Amphoteric polymer | Dose [%] | Comparative polymer | Dose [%] | Increase in bursting strength [%] | Increase in SCT [%] | Increase in CMT [%] | Increase in wet breaking length |
|---|---|---|---|---|---|---|---|---|---|---|---|---|
| Comparison 0 | — | | — | | — | | Polymer C1 | 0.04 | — | — | — | — |
| Comparison 1 | — | | Polymer K1 | 0.15 | — | | Polymer C2 | 0.15 | 18 | 16 | 18 | 145 |
| Comparison 2 | Cation 1 | 0.7 | Polymer K1 | 0.15 | — | | Polymer C2 | 0.15 | 15 | 13 | 16 | 155 |
| Comparison 3 | Cation 1 | 0.7 | — | | Polymer A1 | 0.3 | — | | 24 | 22 | 13 | 34 |
| Example 1 | Cation 1 | 0.7 | Polymer K1 | 0.15 | Polymer A1 | 0.15 | — | | 24 | 26 | 23 | 92 |
| Example 2 | Cation 2 | 0.14 | Polymer K1 | 0.15 | Polymer A1 | 0.15 | — | | 23 | 21 | 23 | 98 |
| Example 3 | Cation 1 | 0.7 | Polymer K1 | 0.15 | Polymer A1 | 0.15 | — | | 19 | 18 | 22 | 116 |
| Example 4 | Cation 1 | 0.7 | Polymer K1 | 0.15 | Polymer A1 | 0.15 | — | | 22 | 24 | 20 | 131 |
| Example 5 | Cation 1 | 0.7 | Polymer K1 | 0.15 | Polymer A1 | 0.15 | — | | 20 | 23 | 21 | 125 |

Comparison 0: zero value determination

Comparison 1: comparison according to DE 10 2004 056 551 A1

Comparison 2: comparison analogous to DE 10 2004 056 551 A1 and additionally premetering of a trivalent cation Comparison 3: comparison according to EP 1849 803 A1

Example 1: metering sequence: cation 1, polymer K1, polymer A1

Example 2: metering sequence: cation 2, polymer K1, polymer A1

Example 3: metering sequence: polymer K1, cation 1, polymer A1

Example 4: metering sequence: mixtures of cation 1 and polymer K1, polymer A1

Example 5: metering sequence: cation 1, polymer A1, polymer K1

TABLE 2a

| | Dose | | | | | | | |
|---|---|---|---|---|---|---|---|---|
| Example | Trivalent cation | Dose [%] | Cationic polymer | Dose [%] | Amphoteric polymer | Dose [%] | Comparative polymer | Dose [%] |
| Comparison 0 | — | | — | | — | | Polymer C1 | 0.04 |
| Comparison 4 | — | | Polymer K1 | 0.15 | — | | Polymer C2 | 0.15 |
| Comparison 5 | Cation 1 | 0.5 | Polymer K1 | 0.15 | — | | Polymer C2 | 0.15 |
| Comparison 6 | Cation 1 | 0.5 | — | | Polymer A1 | 0.3 | — | |
| Comparison 7 | Cation 1 | 0.5 | — | | Polymer A2 | 0.3 | — | |
| Comparison 8 | Cation 1 | 0.5 | — | | Polymer A3 | 0.3 | | |
| Comparison 9 | Cation 1 | 0.5 | — | | — | | Polymer C3 | 0.15 |
| | | | | | | | Polymer C2 | 0.15 |
| Comparison 10 | Cation 1 | 0.5 | — | | Polymer A1 | 0.15 | Polymer C3 | 0.15 |
| Example 6 | Cation 1 | 0.5 | Polymer K1 | 0.15 | Polymer A1 | 0.15 | — | |
| Example 7 | Cation 1 | 0.5 | Polymer K1 | 0.15 | Polymer A2 | 0.15 | — | |
| Example 8 | Cation 1 | 0.5 | Polymer K1 | 0.15 | Polymer A3 | 0.15 | — | |

TABLE 2a-continued

| Example | Trivalent cation | Dose [%] | Cationic polymer | Dose [%] | Amphoteric polymer | Dose [%] | Comparative polymer | Dose [%] |
|---|---|---|---|---|---|---|---|---|
| | | | | Dose | | | | |
| Example 9 | Cation 1 | 0.5 | Polymer K2 | 0.15 | Polymer A1 | 0.15 | — | |
| Example 10 | Cation 1 | 0.5 | Polymer K3 | 0.15 | Polymer A1 | 0.15 | — | |

Comparison 1: zero value determination
Comparison 4: comparison according to DE 10 2004 056 551 A1
Comparison 5: comparison analogous to DE 10 2004 056 551 A1 and additionally premetering of a trivalent cation
Comparison 6: comparison according to EP 1 849 803 A1
Comparison 7: comparison according to JP 54-030913 A1
Comparison 8: comparison according to JP 54-030913 A1
Comparison 9: comparison according to JP 02-112498 A1
Comparison 10: comparison analogous to JP 02-112498 A1
Examples 6 to 10: metering sequence in each case: trivalent cation, cationic polymer, amphoteric polymer TABLE 2b Results for Table 2a

| Example | Increase in bursting strength [%] | Increase in SCT [%] | Increase in CMT [%] | Increase in wet breaking length [m] | Ash content [%] | Drainage time [s] |
|---|---|---|---|---|---|---|
| Comparison 0 | — | — | — | — | 7.6 | 58 |
| Comparison 4 | 19 | 17 | 10 | 136 | 7.8 | 51 |
| Comparison 5 | 15 | 8 | 9 | 123 | 8.0 | 50 |
| Comparison 6 | 24 | 22 | 13 | 34 | 6.8 | 78 |
| Comparison 7 | 13 | 18 | 14 | 60 | 7.1 | 60 |
| Comparison 8 | 17 | 25 | 17 | 75 | 7.5 | 82 |
| Comparison 9 | 7 | 9 | 16 | 98 | 7.9 | 50 |
| Comparison 10 | 8 | 7 | 9 | 126 | 8.2 | 38 |
| Example 6 | 24 | 26 | 23 | 110 | 8.0 | 30 |
| Example 7 | 22 | 23 | 21 | 140 | 7.8 | 33 |
| Example 8 | 23 | 24 | 23 | 135 | 7.9 | 40 |
| Example 9 | 19 | 20 | 19 | 83 | 8.2 | 41 |
| Example 10 | 21 | 19 | 20 | 91 | 7.9 | 47 |

The invention claimed is:

1. A process for producing a paper, board, or cardboard product having high dry strength, the process comprising:

adding (a) a trivalent cation in the form of a salt, (b) a water-soluble cationic polymer, and (c) a water-soluble amphoteric polymer, to a paper stock, thereby forming a resulting paper stock;

draining the resulting paper stock, thereby forming at least one sheet; and subsequently drying the at least one sheet, thereby forming the paper, board, or cardboard product, wherein the water-soluble cationic polymer (b) is at least one selected from the group consisting of (i) a polymer comprising vinylamine units and (ii) a polymer comprising ethylenimine units, wherein the water-soluble amphoteric polymer (c) comprises (A) a structural unit comprising a permanently cationic group or group protonatable in an aqueous medium, (B) a structural unit comprising a group deprotonatable in an aqueous medium, and (C) a nonionic structural unit, wherein the water-soluble amphoteric polymer (c) is obtained by a process comprising a free radical polymerization of monomers in solution, wherein a content of the water-soluble amphoteric polymer (c) is at least 0.1% by weight, based on dry paper stock, and wherein an amount of the trivalent cation (a) in the form of a salt added to the paper stock is from 3 to 100 mol per t of dry paper stock.

2. The process of claim 1, wherein the trivalent cation (a) is at least one selected from the group consisting of $Al^{3+}$, $Zr^{3+}$ and $Fe^{3+}$.

3. The process of claim 2, wherein the trivalent cation (a) is an aluminum sulfate, polyaluminum chloride, aluminum lactate salt, or combination thereof.

4. The process of claim 1, wherein the water-soluble cationic polymer (b) comprises the polymer (i), which comprises a reaction product obtained by at least one selected from the group consisting of:

(1) polymerization of at least one monomer of formula (I)

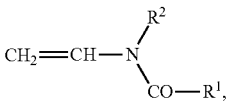

(I)

wherein $R^1$, $R^2$ are, independently, H or $C_1$- to $C_6$-alkyl, followed by partial or complete elimination of —CO—$R^1$ groups from units of the monomers (I) incorporated as polymerized units into a resulting polymer with formation of amino groups; and (2) Hofmann degradation of at least one polymer having at least one acrylamide unit, methacrylamide unit, or both.

5. The process of claim 4, wherein the polymer (i) comprises a reaction product obtained by polymerization of:

(1) at least one monomer of formula (I)

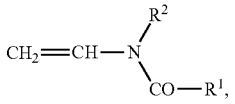

(I)

wherein R', $R^2$ are, independently, H or $C_1$- to $C_6$-alkyl;

(2) optionally at least one other monoethylenically unsaturated monomer; and (3) optionally at least one crosslinking monomer having at least two double bonds in a molecule, followed by partial or complete elimination of —CO—$R^1$ groups from units of the monomers (I) incorporated as polymerized units into a resulting polymer with formation of amino groups.

6. The process of claim 5, wherein the polymer (i) comprises a reaction product obtained by polymerization of N-vinylformamide, followed by elimination of formyl groups from vinylformamide units incorporated as polymerized units into a resulting polymer with formation of amino groups.

7. The process of claim 5, wherein the polymer (i) comprises a reaction product obtained by copolymerization of (1) N-vinylformamide, and (2) acrylonitrile, followed by elimination of formyl groups from vinylformamide units incorporated as polymerized units into a resulting copolymer with the formation of amino groups.

8. The process of claim 4, wherein the polymer (i) comprises a reaction product obtained by polymerization of:

(1) at least one monomer of formula (I)

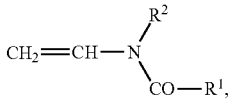

(I)

wherein $R^1$, $R^2$ are, independently, H or $C_1$- to $C_6$-alkyl;

(2) at least one monomer comprising an acid function and at least one selected from the group consisting of a monoethylenically unsaturated sulfonic acid, a monoethylenically unsaturated phosphonic acid, a monoethylenically unsaturated carboxylic acid having 3 to 8 carbon atoms in a molecule, and alkali metal, alkaline earth metal, or ammonium salts thereof;

(3) optionally at least one other neutral, cationic, or both neutral and cationic, monomer; and (4) optionally at least one crosslinking monomer comprising at least two double bonds in a molecule, followed by partial or complete elimination of the —CO—$R^1$ groups from the units of the monomers (I) incorporated as polymerized units into a resulting copolymer with the formation of amino groups, wherein a content of amino groups in the resulting copolymer is at least 5 mol % above a content of acid groups of the monomer (2) incorporated as polymerized units.

9. The process of claim 8, wherein the polymer (i) comprises a reaction product obtained by polymerization of (1) N-vinylformamide, (2) at least one monomer selected from the group consisting of acrylic acid, methacrylic acid, and an alkali metal, alkaline earth metal, or ammonium salt thereof, and (3) optionally acrylonitrile, methacrylonitrile, or both, followed by partial or complete elimination of formyl groups from N-vinylformamide incorporated as polymerized units into a resulting copolymer with formation of amino groups, wherein a content of amino groups in the resulting copolymer is at least 5 mol % above a content of acid groups of the monomer (2) incorporated as polymerized units.

10. The process of claim 1, wherein the water-soluble cationic polymer (b) comprises the polymer (ii), which comprises at least one water-soluble cationic polymer selected from the group consisting of a homopolymer of ethylenimine, a polyethylenimine reacted with one or more at least bifunctional crosslinking agents, a polyamidoamine grafted with ethylenimine and reacted with one or more at least bifunctional crosslinking agents, a reaction product of a polyethylenimine with at least one monobasic carboxylic acid to give at least one amidated polyethylenimine, a Michael adduct of at least one polyethylenimine with at least one ethylenically unsaturated acid, salt, ester, amide or nitrile of a monoethylenically unsaturated carboxylic acid, a phosphonomethylated polyethylenimine, a carboxylated polyethylenimine, and an alkoxylated polyethylenimine.

11. The process of claim 10, wherein the polymer (ii) comprises a homopolymer of ethylenimine, a polyamidoamine grafted with ethylenimine, or both, that is subsequently reacted with one or more at least bifunctional crosslinking agents.

12. The process of claim 4, wherein an amount of the water-soluble cationic polymer (b) added is from 0.01 to 2.0% by weight, based on dry paper stock.

13. The process of claim 1, wherein a proportion of monomers whose resulting polymers comprise the structural units (C), in the water-soluble amphoteric polymer (c), is at least 50% by weight, based on a total weight of monomers within the water-soluble amphoteric polymer (c).

14. The process of claim 1, wherein:

the structural unit (B) comprises at least one selected from the group consisting of a monomer of the formula (II) and salts thereof

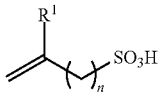

(II)

$R^1$ is H or a $C_1$-$C_4$-alkyl group; and n is an integer from 1 to 8.

15. The process of claim 1, wherein adding (a) a trivalent cation in the form of a salt, (b) a water-soluble cationic polymer, and (c) a water-soluble amphoteric polymer, to a paper stock comprises:

first adding the trivalent cation (a) in the form of a salt to the paper stock, followed by adding the water-soluble cationic polymer (b), followed by adding the water-soluble amphoteric polymer (c).

16. The process of claim 1, wherein adding (a) a trivalent cation in the form of a salt, (b) a water-soluble cationic polymer, and (c) a water-soluble amphoteric polymer, to a paper stock comprises:

first adding the trivalent cation (a) in the form of a salt to the paper stock, followed by adding the water-soluble amphoteric polymer (c), followed by adding the water-soluble cationic polymer (b).

17. The process of claim 1, wherein adding (a) a trivalent cation in the form of a salt, (b) a water-soluble cationic polymer, and (c) a water-soluble amphoteric polymer, to a paper stock comprises:

first adding a mixture of the trivalent cation (a) in the form of a salt and of the water-soluble amphoteric polymer (c), and then adding the water-soluble cationic polymer (b) is added.

18. A paper obtained by the process of claim 1.

19. The process of claim 1, further comprising polymerizing monomers in solution in a free radical polymerization, thereby obtaining the water-soluble amphoteric polymer (c).

20. A process for producing a paper, board, or cardboard product having high dry strength, the process comprising:

adding (a) a trivalent cation in the form of a salt, (b) a water-soluble cationic polymer, and (c) a water-soluble amphoteric polymer, to a paper stock, thereby forming a resulting paper stock;

draining the resulting paper stock, thereby forming at least one sheet; and subsequently drying the at least one sheet, thereby forming the paper, board, or cardboard product, wherein the water-soluble cationic polymer (b) comprises (i) a polymer comprising vinylamine units, wherein the water-soluble amphoteric polymer (c) comprises (A) a structural unit comprising a permanently cationic group or group protonatable in an aqueous medium, (B) a structural unit comprising a group deprotonatable in an aqueous medium, and (C) a nonionic structural unit, wherein the water-soluble amphoteric polymer (c) is obtained by a process comprising a free radical polymerization of monomers in solution, wherein a content of the water-soluble amphoteric polymer (c) is at least 0.1% by weight, based on dry paper stock, and wherein the polymer (i) comprises a reaction product obtained by Hofmann degradation of homo- or copolymers of acrylamide or of methacrylamide in an aqueous medium in the presence of sodium hydroxide solution and sodium hypochlorite, followed by decarboxylation of carbamate groups of resulting reaction products in the presence of an acid.

21. The process of claim 20, wherein an amount of the trivalent cation (a) in the form of a salt added to the paper stock is from 3 to 100 mol per t of dry paper stock.

* * * * *